US006952999B2

(12) United States Patent
Toya

(10) Patent No.: US 6,952,999 B2
(45) Date of Patent: Oct. 11, 2005

(54) SEWING MACHINE NEEDLE

(75) Inventor: Yutaka Toya, Nagano (JP)

(73) Assignee: Organ Needle Co., Ltd., Nagano-ken (JP)

( * ) Notice: Subject to any disclaimer, the term of this patent is extended or adjusted under 35 U.S.C. 154(b) by 238 days.

(21) Appl. No.: 10/690,314

(22) Filed: Oct. 21, 2003

(65) Prior Publication Data

US 2004/0079265 A1 Apr. 29, 2004

(30) Foreign Application Priority Data

Oct. 25, 2002 (JP) ..... 2002-310955

(51) Int. Cl.[7] ..... D05B 85/00
(52) U.S. Cl. ..... 112/222
(58) Field of Search ..... 112/222, 223, 112/224, 225, 80.01, 80.4; 163/1, 5; 223/99

(56) References Cited

U.S. PATENT DOCUMENTS 1,443,456 A * 1/1923 Bretschneider ..... 112/224
3,347,192 A 10/1967 Lukins
4,458,614 A * 7/1984 Iwashita ..... 112/222
5,215,021 A 6/1993 Fuhrmann
5,797,961 A 8/1998 Smith et al.
6,318,281 B2 11/2001 Hillenbrand et al.
6,332,416 B1 * 12/2001 Wohnhas et al. ..... 112/222
6,332,417 B1 * 12/2001 Vornholt ..... 112/222

FOREIGN PATENT DOCUMENTS

EP 0 538 486 11/1992
JP 11-216289 10/1999

* cited by examiner

*Primary Examiner*—Ismael Izaguirre

(57) ABSTRACT

A sewing machine needle capable of preventing stitch skipping and fabric yarn breakage, irrespective of high-speed and multifunction sewing machines and diversified materials being used. Over a predetermined length from an edge, closer to a needle point, of a needle eye toward the needle point, a blade has a straight profile extending parallel to a longitudinal axis of the needle as viewed from a side of the needle in a direction orthogonal to a direction in which the needle eye extends. Over a predetermined length from the straight profile portion toward the needle point, the profile of the blade is a flat cross-section in which the thickness thereof in the direction in which the needle eye extends is larger than the width thereof in the direction orthogonal to the direction in which the needle eye extends. In a needle point portion following the flat cross-section portion and extending to the needle point, the blade has a sectional shape of a perfect circle.

2 Claims, 3 Drawing Sheets

SEWING MACHINE NEEDLE

BACKGROUND OF THE INVENTION

1. Field of the Invention

The present invention relates to a sewing machine needle having less possibility of causing stitch skipping or fabric yarn breakage, irrespective of high-speed and multifunction sewing machines and diversified materials being used.

2. Description of the Related Art

Sewing machines used in sewing are roughly classified into ones for industrial use and ones for domestic use.

The industrial sewing machines are generally used at high rotational speeds from the viewpoint of pursuing productivity, and the rotational speed thereof may come up to as high as 8000 rpm. In automated industrial sewing machines, seams are formed in multi-directions and loops that are important for formation of the seams tend to become unstable under the influence of sewing threads having a certain twist angle.

A fabric feeding mechanism of automated sewing machines such as pattern seamers or cycle sewing machines employs an X-Y table to realize multi-directional sewing. When a tip of a rotary hook passes a scarf of a sewing machine needle, minute oscillations of the X-Y table cause a large shaking of the needle from the scarf thereof to a needle point thereof. As a result, the tip of the rotary hook fails to catch a loop so that stitch skipping is liable to occur.

In the conventional techniques, for the purpose of suppressing such stitch skipping arising from the shaking of the needle, the dimensions of a needle dropping portion or needle dropping hole of the rotary hook are lessened with respect to the thickness of the sewing machine needle so that the clearance therebetween is minimized to reduce the shaking of the needle. Due to a tip end portion of the sewing machine needle having to reciprocate through the needle dropping hole, however, the dimensions of the needle dropping hole can not be made smaller than the thickness of the needle in a direction in which a needle eye extends. In addition, since the tip end portion of the conventional sewing machine needle is tapered, the clearance between the needle and the needle dropping hole inevitably becomes large.

On the contrary, the household sewing machines have seldom experienced such problems so far unlike the industrial sewing machines since the former is basically used at a low rotational speed. Recently, however, more and more household sewing machines have come to employ an additional embroidery function. Since their mechanisms are similar to those of the automated industrial sewing machines, the household sewing machines are also facing the same problems as those of the industrial sewing machines.

A variety of materials used for sewn products have diversely been developed. Recent tendency is toward frequent development of materials rich in stretchability, which have come to be used for sewn products called heavy products such as jeans, which use has not hitherto been present by any means. Extremely delicate jersey-based materials have also come to be used for automobile seats and have posed another essential problem of fabric yarn breakage in addition to the sewing problems such as stitch skipping and needle breakage.

Thus, recent years have not required addressing only a single sewing trouble as before but have required a high-performance sewing machine needle capable of effectively coping with a plurality of sewing troubles, especially, combined troubles of stitch skipping and fabric yarn breakage.

SUMMARY OF THE INVENTION

The present invention has been made in order to solve the above problems. It is therefore an object of the present invention to provide a sewing machine needle capable of preventing stitch skipping and fabric yarn breakage, irrespective of high-speed and multifunction sewing machines and diversified materials being used.

To attain the above.object, according to the present invention there is provided a sewing machine needle. The sewing machine needle comprises a blade which includes a needle point and has a needle eye formed at a portion thereof in the vicinity to the needle point, wherein over a predetermined length from an edge, closer to the needle point, of the needle eye toward the needle point, the blade has a straight profile extending parallel to a longitudinal axis of the needle as viewed from a side of the needle in a direction orthogonal to a direction in which the needle eye extends; over a predetermined length from the straight profile portion toward the needle point, the blade has a profile of a flat cross-section in which a thickness thereof in the direction in which the needle eye extends is larger than a width thereof in the direction orthogonal to the direction in which the needle eye extends; and in a needle point portion following the flat cross-section portion and extending to the needle point, the blade has a sectional shape of a perfect circle.

In the case of the sewing machine needle thus configured, by virtue of such a configuration that over a predetermined length from the edge, closer to the needle point, of the needle eye toward the needle point, the blade has the straight profile extending parallel to the longitudinal axis of the needle as viewed from the side of the needle in the direction orthogonal to the direction in which the needle eye extends, it is possible to reduce the clearance between the blade of the needle and a needle dropping portion of a rotary hook during sewing, to thereby more positively suppress the occurrence of stitch skipping as compared with conventional sewing machine needles.

By virtue of such a configuration that over a predetermined length from the straight profile portion toward the needle point, the blade has the profile of a flat cross-section in which the thickness thereof in the direction in which the needle eye extends is larger than the width thereof in the direction orthogonal to the direction in which the needle eye extends, it is possible to lower a puncture resistance of the sewing machine needle, to thereby suppress the occurrence of fabric yarn breakage during sewing.

By virtue of such a configuration that in the needle point portion following the flat cross-section portion and extending to the needle point, the blade has the sectional shape of a perfect circle, the needle point portion is allowed to slide on the surfaces of fabric yarns to penetrate fabric when the needle point portion is inserted into the fabric, whereby it is possible to prevent the needle point portion from damaging the fabric yarns, and it is possible to uniformly distribute in all directions the resistance to which the fabric yarns in contact with the perfect circle section of the needle point portion are subjected and reduce the resistance, to thereby more positively prevent the occurrence of the fabric yarn breakage.

In order to achieve the effects more positively or in the most effective manner possible, it is preferred that the length of the straight profile portion be within a range of 0.5 to 1.5 mm, and that the length of the needle point portion be within a range of 0.5 to 1.5 mm.

BRIEF DESCRIPTION OF THE DRAWINGS

The above and other objects, aspects, features and advantages of the present invention will become more apparent from the following detailed description when taken in conjunction with the accompanying drawings, in which.

DETAILED DESCRIPTION OF THE INVENTION

A preferred embodiment of the present invention will now be described with reference to the drawings.

Referring first to FIGS. 1A to 1F, an embodiment of a sewing machine needle in accordance with the present invention is illustrated.

Figure 1A:
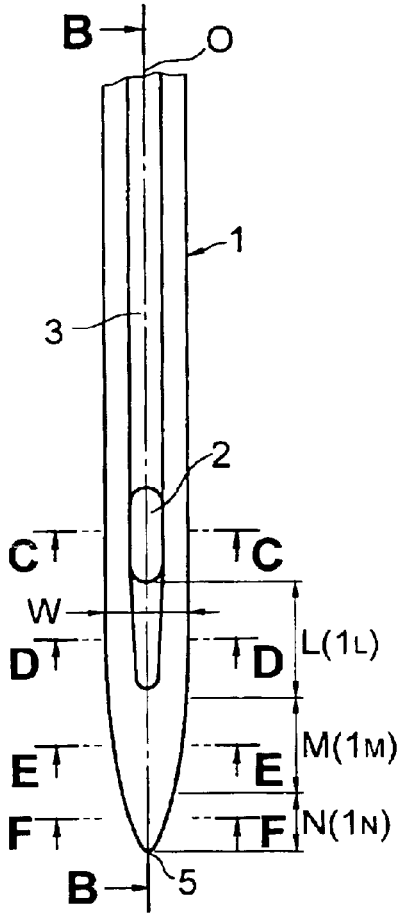
FIGS. 1A to 1F illustrate an embodiment of a sewing machine needle in accordance with the present invention, FIG. 1A being an enlarged front view of an extremity portion of the sewing machine needle, FIG. 1B being a longitudinal sectional view of the extremity portion of the sewing machine needle taken along line B—B of FIG. 1A, and FIGS. 1C to 1F being transverse sectional views of the extremity portion of the sewing machine needle taken along lines C—C to F—F of FIG. 1A, respectively.
Figure 1B:
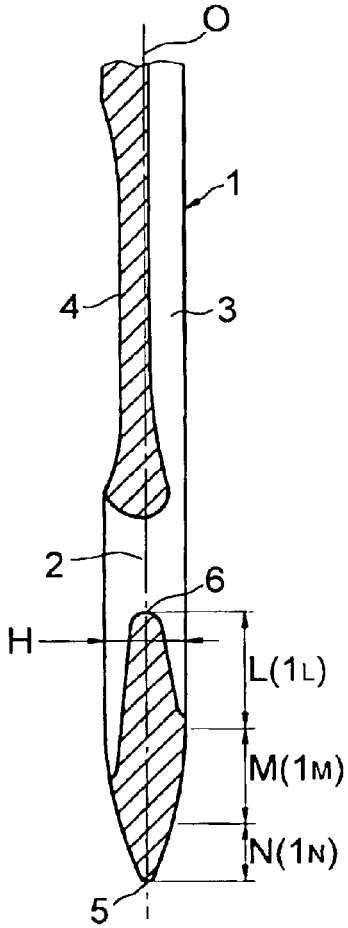

In the figures, reference numeral 1 denotes a blade, reference numeral 2 denotes a needle eye formed at a distal end portion of the blade 1 in the vicinity to a needle point 5, reference numeral 3 denotes a long groove formed along the front side of the blade surface, and reference numeral 4 denotes a scarf . The sewing machine needle according to the embodiment is configured as shown in FIG. 1B such that over a predetermined length L from an edge 6, closer to the needle point 5, of the needle eye 2 toward the needle point 5, the blade 1 has a straight profile (i.e., thickness H=constant) extending parallel to a longitudinal axis O of the needle as viewed from a side of the needle in a direction orthogonal to a direction in which the needle eye 2 extends; that over a predetermined length M from the straight profile portion $\mathbf{1}_L$ toward the needle point 5, the blade 1 has a profile of a flat cross-section in which the thickness H thereof in the direction in which the needle eye 2 extends is larger than a width W thereof in the direction orthogonal to the direction in which the needle eye 2 extends (see FIG. 1E); and that in a needle point portion $\mathbf{1}_N$ following the flat cross-section portion $\mathbf{1}_M$ and extending to the needle point 5, the blade 1 has a sectional shape of a perfect circle (see FIG. 1F).

Figure 1C:
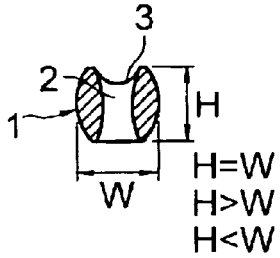
Figure 1D:
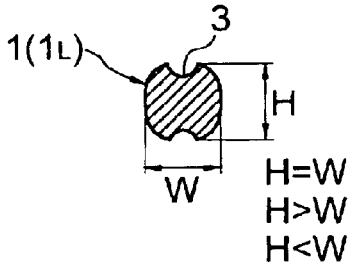
Figure 1E:
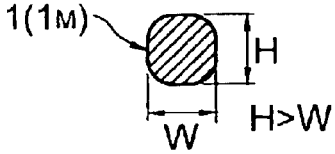
Figure 1F:
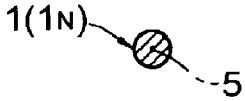

In the present invention, to perform desired operational functions, the flat cross-section portion $\mathbf{1}_M$ of the blade 1 is required to have a flat sectional shape satisfying the relation H>W, although the portions of the blade 1 located on an upper side of the flat cross-section portion $\mathbf{1}_M$ or shank side need not necessarily have a flat sectional shape but may have simply a sectional shape satisfying any one of the relations H=W, H>W, and H<W as shown in FIGS. 1C and 1D. As seen in FIG. 1A, when viewed from the front of the needle, i.e., from the direction in which the needle eye 2 extends, the straight profile portion $\mathbf{1}_L$ and the flat cross-section portion $\mathbf{1}_M$ of the blade 1 are formed to have a tapered profile in which the width W thereof is gradually narrowed rectilinearly or curvilinearly toward the needle point 5.

The blade 1 has, as described above, the straight profile portion $\mathbf{1}_L$ parallel to the longitudinal axis O of the needle, as viewed from the side of the needle, over the predetermined length L from the edge 6, closer to the needle point 5, of the needle eye 2 toward the needle point 5. Such construction, as shown in FIG. 2B, can reduce a clearance 22 between the needle and a needle dropping portion 21 of a rotary hook during sewing, to thereby more positively suppress the occurrence of stitch skipping as compared with a conventional sewing machine needle. It is preferable that the length L of the straight profile portion $\mathbf{1}_L$ be within a range of 0.5 to 1.5 mm, as mentioned above.

Figure 2A:
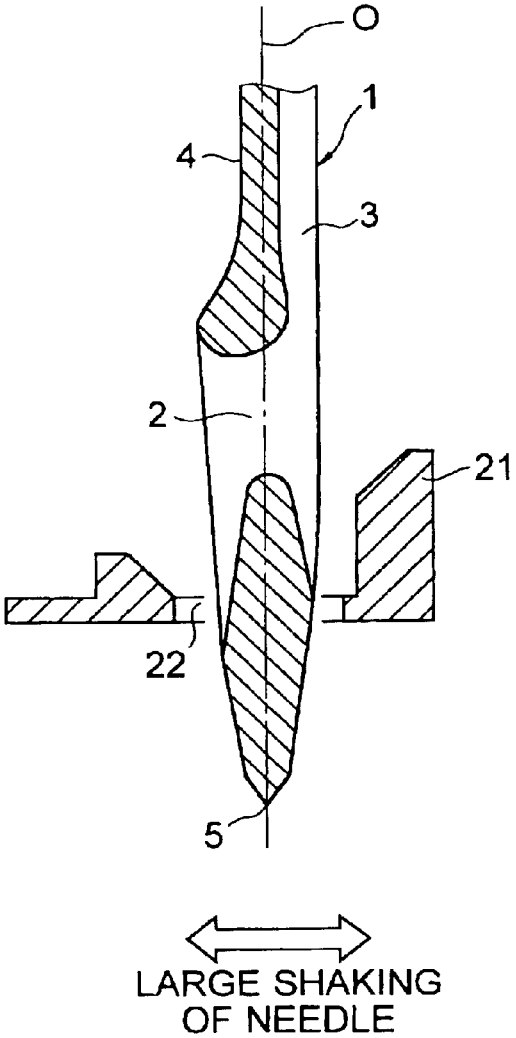
FIGS. 2A and 2B each illustrate a clearance between the sewing machine needle and a needle dropping portion of a rotary hook, FIG. 2A being a sectional view showing the clearance in the case of a conventional sewing machine needle, and FIG. 2B being a sectional view showing the clearance in the case of the sewing machine needle of the present invention.
Figure 2B:
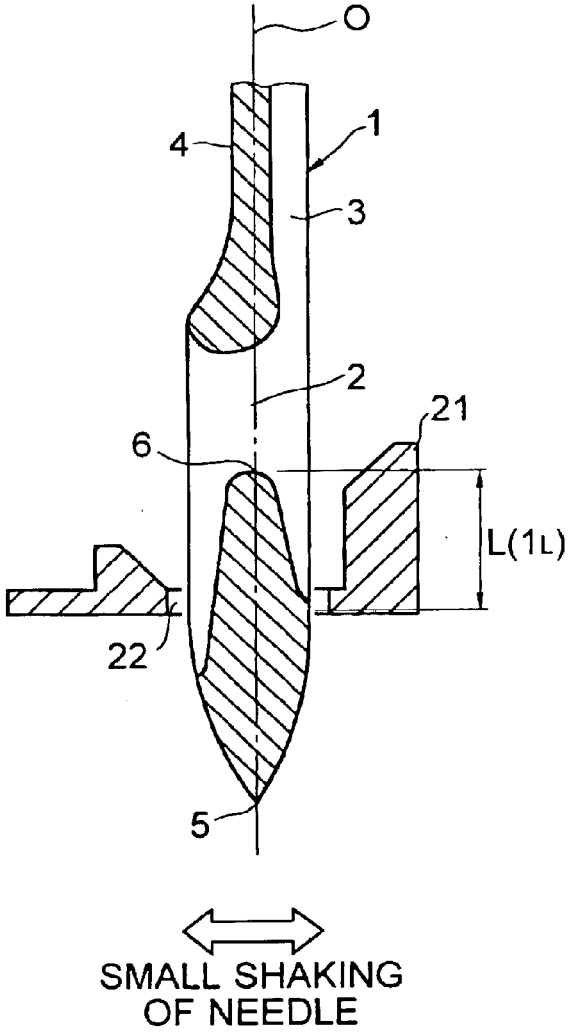

For the purpose of comparison, the state of the clearance in the case of the conventional sewing machine needle is shown in FIG. 2A. In the conventional sewing machine needle, a portion of the blade 1, which corresponds to the straight profile portion $\mathbf{1}_L$ of the blade 1 and its vicinity in the sewing machine needle of the present invention, is also tapered toward the needle point 5, so that the clearance 22 between the needle and the needle dropping portion 21 of the rotary hook becomes larger, with the result that the conventional sewing machine needle tends to easily cause stitch skipping.

In addition, in the present invention, the blade 1 has the flat cross-section portion $\mathbf{1}_M$ in which the thickness H thereof in the direction in which the needle eye 2 extends is larger than the width W thereof in the direction orthogonal to the direction in which the needle eye 2 extends, over the predetermined length M from the straight profile portion $\mathbf{1}_L$ toward the needle point 5, to thereby lower puncture resistance of the sewing machine needle, so that the fabric yarn breakage during sewing can be prevented.

Figure 3A:
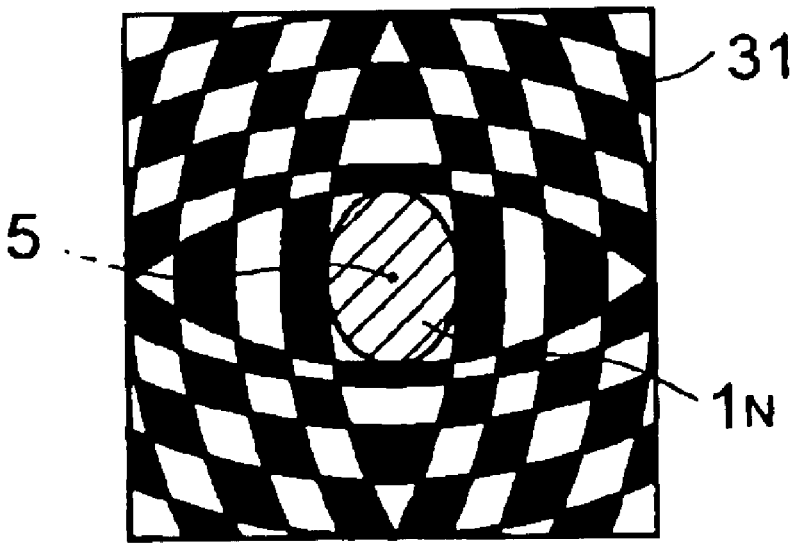
FIGS. 3A and 3B each illustrate a state in which the sewing machine needle penetrates fabric, FIG. 3A being a schematic view showing the state where the conventional sewing machine needle penetrates the fabric, and FIG. 3B being a schematic view showing the state where the sewing machine needle of the present invention penetrates the fabric.
Figure 3B:
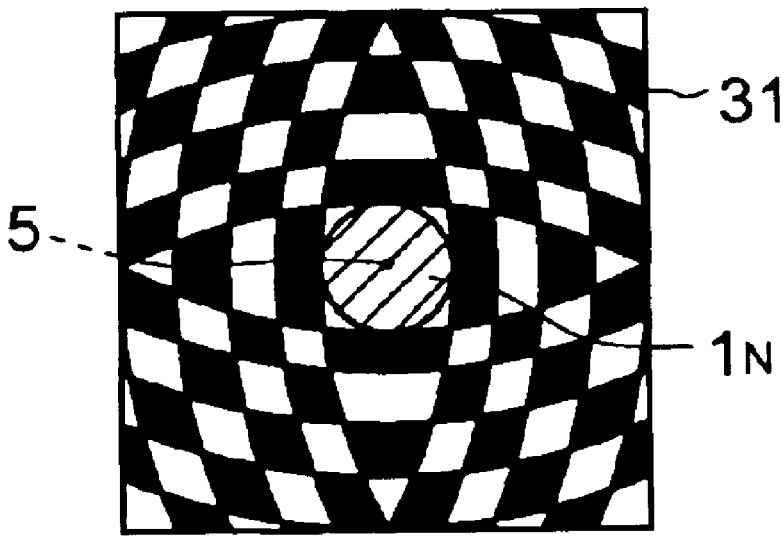

Furthermore, the needle point portion $\mathbf{1}_N$ of the blade 1 connected to the needle point 5 is formed to have a sectional shape of a perfect circle, so that the needle point portion $\mathbf{1}_N$ is allowed to slide on the surfaces of fabric yarns 31 to penetrate fabric when the needle point portion $\mathbf{1}_N$ having a perfect circle section is inserted into the fabric as shown in FIG. 3B. For this reason, the fabric yarns 31 cannot be damaged and the resistance to which the fabric yarns 31 in contact with the perfect circle section of the needle point portion $\mathbf{1}_N$ are subjected can be uniformly distributed in all directions and reduced, so that the fabric yarn breakage can be more positively prevented from occurring. It is preferable that the length N of the needle point portion 1N having a perfect circle section be within a range of 0.5 to 1.5 mm, as described above.

In a case where the needle point portion $\mathbf{1}_N$ of the blade 1 is formed to have a flat sectional shape other than a perfect circle, such as an ellipse or the like, unlike the present invention, it is difficult to uniformly distribute in all directions the resistance to which the fabric yarns 31 in contact with the flat section of the needle point portion $\mathbf{1}_N$ are subjected, with the result that the fabric yarn breakage is liable to be caused.

Although in the above embodiment so-called a single-grooved sewing machine needle having only the front long groove 3 has been exemplified, it is a matter of course that the present invention may be applicable equally to a double-grooved sewing machine needle having a rear long groove in addition to the front long groove. Sewing machines using the double-grooved sewing machine needle employ a needle guard in lieu of the needle dropping portion 21 of the rotary hook shown in FIGS. 2A and 2B. Furthermore, in embodying the present invention, the needle point may be formed to have a spherical shape which is not shown.

As set forth hereinabove, the sewing machine needle of the present invention is configured such that over a predetermined length from the edge, closer to the needle point, of the needle eye toward the needle point, the blade has a straight profile extending parallel to the longitudinal axis of the needle as viewed from the side of the needle in the direction orthogonal to the direction in which the needle eye extends; that over a predetermined length from the straight profile portion toward the needle point, the blade has a profile of a flat cross-section in which the thickness thereof in the direction in which the needle eye extends is larger than the width thereof in the direction orthogonal to the direction in which the needle eye extends; and that in the needle point portion following the flat cross-section portion and extending to the needle point, the blade has a sectional shape of a perfect circle. Such configuration permits the sewing machine needle to offer a high performance to effectively prevent stitch skipping and fabric yarn breakage, irrespective of high-speed and multifunction sewing machines and diversified materials being used.

While an illustrative and presently preferred embodiment of the present invention has been described in detail herein, it is to be understood that the inventive concepts may be otherwise variously embodied and employed and that the appended claims are intended to be construed to include such variations except insofar as limited by the prior art.

What is claimed is:

1. A sewing machine needle comprising a blade which includes a needle point and has a needle eye formed at a portion thereof in the vicinity to said needle point; wherein over a predetermined length from an edge, closer to said needle point, of said needle eye toward said needle point, said blade has a straight profile extending parallel to a longitudinal axis of the needle as viewed from a side of the needle in a direction orthogonal to a direction in which said needle eye extends;

over a predetermined length from the straight profile portion toward said needle point, said blade has a profile of a flat cross-section in which a thickness thereof in the direction in which said needle eye extends is larger than a width in the direction orthogonal to the direction in which said needle eye extends; and in a needle point portion following the flat cross-section portion and extending to said needle point, said blade has a sectional shape of a perfect circle.

2. The sewing machine needle according to claim 1, wherein the length of the straight profile portion is within a range of 0.5 to 1.5 mm, and the length of said needle point portion is within a range of 0.5 to 1.5 mm.

* * * * *